US011305917B2

(12) United States Patent
Aryanpanah et al.

(10) Patent No.: US 11,305,917 B2
(45) Date of Patent: Apr. 19, 2022

(54) RESEALABLE CHILDPROOF BAG SYSTEM AND METHOD

(71) Applicant: AA Global Imports, Inc., Vernon, CA (US)

(72) Inventors: David Aryanpanah, Beverly Hills, CA (US); Brian Anav, Beverly Hills, CA (US); Chao Liu, Shandong (CN)

(73) Assignee: FEAC AGENT, LLC, Boston, MA (US)

( * ) Notice: Subject to any disclaimer, the term of this patent is extended or adjusted under 35 U.S.C. 154(b) by 0 days.

(21) Appl. No.: 17/112,281

(22) Filed: Dec. 4, 2020

(65) Prior Publication Data

US 2021/0086951 A1 Mar. 25, 2021

Related U.S. Application Data

(63) Continuation-in-part of application No. PCT/CN2018/114783, filed on Nov. 9, 2018.

(51) Int. Cl.
*B65D 33/25* (2006.01)

(52) U.S. Cl.
CPC ..... *B65D 33/2566* (2013.01)

(58) Field of Classification Search
CPC . B65D 33/2566; B65D 50/00; B65D 2215/00
See application file for complete search history.

(56) References Cited

U.S. PATENT DOCUMENTS

| | | | | | |
|---|---|---|---|---|---|
| 5,140,727 | A * | 8/1992 | Dais | B65D 33/255 | 24/400 |
| 5,403,094 | A * | 4/1995 | Tomic | B65D 33/255 | 24/DIG. 50 |
| 5,647,100 | A * | 7/1997 | Porchia | B65D 33/2508 | 24/30.5 R |
| 5,972,396 | A * | 10/1999 | Jurgovan | B65D 33/2533 | 426/106 |
| 9,327,875 | B2 * | 5/2016 | Pawloski | B65D 33/2508 | |
| 9,505,531 | B2 * | 11/2016 | Chapek | B65D 50/00 | |
| 10,124,932 | B2 * | 11/2018 | Martial | B65D 33/007 | |
| 2012/0045151 | A1 * | 2/2012 | Eouzan | B65D 33/2541 | 383/42 |
| 2012/0106876 | A1 * | 5/2012 | Pawloski | B65D 33/255 | 383/97 |

(Continued)

*Primary Examiner* — Derek J Battisti
(74) *Attorney, Agent, or Firm* — Jafari Law Group, Inc.

(57) ABSTRACT

A bag including a childproof resealable closure system. The bag includes an opening extending from a first end to a second end configured with a closure system to seal the opening. The closure system includes a first elongate closure element and a second elongate closure element, coupled to opposing sidewalls of the bag and extending from the first end to the second end. The first and second elongate closure elements may be resealably interlocked to provide the seal. The first closure element may be coupled to its sidewall along its lower portion while leaving the upper portion of the closure element substantially disconnected. The second closure element may be coupled to its sidewall along its upper and lower portions. The second closure element may include a discreet partial gap along its length to facilitate the gripping and separating of the closure system, to render the resealable bag childproof.

15 Claims, 7 Drawing Sheets

(56) References Cited

U.S. PATENT DOCUMENTS

| | | | | |
|---|---|---|---|---|
| 2012/0301056 | A1* | 11/2012 | Anzini | B65D 33/255<br>383/61.2 |
| 2016/0101904 | A1* | 4/2016 | Takigawa | B65D 33/2566<br>24/30.5 R |
| 2018/0257820 | A1* | 9/2018 | Tameda | B65D 33/2533 |

* cited by examiner

RESEALABLE CHILDPROOF BAG SYSTEM AND METHOD

PRIORITY NOTICE

The present application is a National Stage and continuation-in-part Application of International application PCT/CN2018/114783, filed on Nov. 9, 2018, which claims priority to Chinese Patent Application CN201821558272.3U, filed on Sep. 25, 2018, the disclosure of which is incorporated herein by reference in its entirety.

TECHNICAL FIELD OF THE INVENTION

The present invention relates generally to bags, and more specifically, to resealable childproof bags for storing items such as medicinal consumables in a manner that restricts access to children.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

Resealable bag enclosures are used throughout the world to contain and store all kinds of products. The bag enclosures may utilize any number of resealable closure systems, such as zip locks, adhesive tabs, or other types of closure systems. At present, self-sealing bags with raised and recessed strips have the following features: (1) the seal is tight and can effectively prevent contamination, prevent moisture, prevent water, prevent bugs, and prevent things from falling out; (2) only a light press is needed to seal tightly, nontoxic, odorless, good flexibility, easy closing, and very convenient; and (3) low prices, reusable, energy-saving, and environmentally friendly. Therefore, they have become indispensable daily supplies in daily life and been extensively used in industries such as product packaging and storage of food, decorations, accessories, medicines, cosmetics, frozen food, mail, etc.

For bag enclosures requiring airtight seals, zip lock resealable closure systems are oftentimes the most popular. As is known in the art, a zip lock seal may include opposing sealing members with interlocking profiles that when pressed together may create an airtight seal, and when pulled outward from one another may allow the seal to be opened. These types of bags are highly functional, well known, easily understood, easy to use, and inexpensive to produce. Bag enclosures with these types of closure systems are used to store all kinds of products ranging from fruits and vegetables, to raw and/or frozen foods.

In addition, with the legalization of cannabis, bag enclosures with zip lock closure systems are now being used to contain and store cannabis. However, because cannabis is a controlled substance that should not be made available to minors, storing cannabis in bags with standard zip lock closure systems may be inadequate in preventing minors from gaining access to the cannabis. That is, because a minor may understand how to open a standard zip lock closure, the use of such a bag may lead to harmful consequences.

Accordingly, there is a need for a resealable bag system utilizing a zip lock closure system to provide the benefits of such a system for use with storing cannabis, but that includes a childproof element that prevents minors from opening the bag.

It is to these ends that the present invention has been developed.

SUMMARY OF THE INVENTION

To minimize the limitations in the prior art, and to minimize other limitations that will be apparent upon reading and understanding the present specification, the present invention describes a resealable childproof bag system and method.

Most self-sealing bags with raised and recessed strips are closed in a manner in that raised strips and recessed strips are in mutual snap-fit to seal articles inside a bag body. A slider is installed on the self-sealing strips, and a self-sealing bag can be opened and closed by sliding the slider. However, the slider installed on the self-sealing strips takes up a certain length, and as a result, the self-sealing bag cannot be fully sealed. At the same time, a child can fully open the self-sealing bag by lightly sliding the slider using a hand, and it would be easy for an accident of ingestion by children to occur when a non-food article that children aren't supposed to access is held inside the bag.

In an exemplary embodiment, a resealable bag system is provided. The resealable bag system may include: a bag body including a first sidewall and an opposing second sidewall defining an inner volume therebetween with an upper opening extending from a first end to a second end; a first closure element comprising: a first locking member and a second locking member below the first locking member, each protruding from a first base member, the first locking member, the second locking member and the first base member extending from the first end to the second end; and a second closure element comprising: a third locking member and a fourth locking member below the third locking member, each protruding from a second base member, the fourth locking member and the first base member extending from the first end to the second end, the third locking member extending from the first end and terminating at a first intermediate location between the first end and the second end, and extending from the second end and terminating at a second intermediate location between the first end and the second end to form a gap that facilitates opening the first and second closure elements; wherein the first and second locking members are resealably interlocked with the third and fourth interlocking members, respectively.

In some exemplary embodiments, the resealable bag system may include: a bag body including a first sidewall and an opposing second sidewall defining an inner volume therebetween with an upper opening extending from a first end to a second end; a first closure element comprising: a first locking member and a second locking member below the first locking member, each protruding from a first base member, the first locking member, the second locking member and the first base member extending from the first end to the second end, wherein the first base member includes an upper portion and a lower portion, the lower portion coupled to the first sidewall and the upper portion substantially not coupled to the first sidewall; and a second closure element comprising: a third locking member and a fourth locking member below the third locking member, each protruding from a second base member, the fourth locking member and the first base member extending from the first end to the second end, the third locking member extending from the first end and terminating at a first intermediate location between the first end and the second end, and extending from the second end and terminating at a second intermediate location between the first end and the second end, the first intermediate location being closer to the first end than the second intermediate location is from the first end to form a gap that facilitates opening the first and second closure elements; wherein the second base member includes an upper portion and a lower portion, the upper portion and the lower portion coupled to the second sidewall; wherein the first and second locking members are resealably interlocked with the third and fourth interlocking members, respectively.

In some exemplary embodiments, only the bottom portion and/or the end portions of the first base member are coupled to the first side wall. In some exemplary embodiments, the first and fourth locking members each include an elongate channel-shaped female interlocking profile, and the second and third locking members and each include an elongate arrow-shaped male interlocking profile.

In some exemplary embodiments, the first and fourth locking members each include an elongate arrow-shaped male interlocking profile, and the second and third locking members and each include an elongate channel-shaped female interlocking profile.

In some exemplary embodiments, the shortest distance between the first intermediate location and the second intermediate location is 0.1"-2.0". In some exemplary embodiments, the first and second closure elements comprise thermoplastic.

Various objects and advantages of the present invention will become apparent from the following description taken in conjunction with the accompanying drawings wherein are set forth, by way of illustration and example, certain embodiments of this invention. The drawings submitted herewith constitute a part of this specification, include exemplary embodiments of the present invention, and illustrate various objects and features thereof.

BRIEF DESCRIPTION OF THE DRAWINGS

The resealable bag system and method as disclosed herein are further described in terms of exemplary embodiments. These embodiments are described in detail with reference to the drawings, which have not necessarily been drawn to scale, in order to enhance their clarity and improve understanding of the various embodiments of the invention. Furthermore, elements that are known to be common and well understood to those in the industry are not depicted in order to provide a clear view of the various embodiments of the invention. These embodiments are non-limiting exemplary embodiments, in which like reference numerals represent similar structures throughout the several views of the drawings. The drawings that accompany the detailed description can be briefly described as follows.

DETAILED DESCRIPTION OF THE INVENTION

Figure 1:
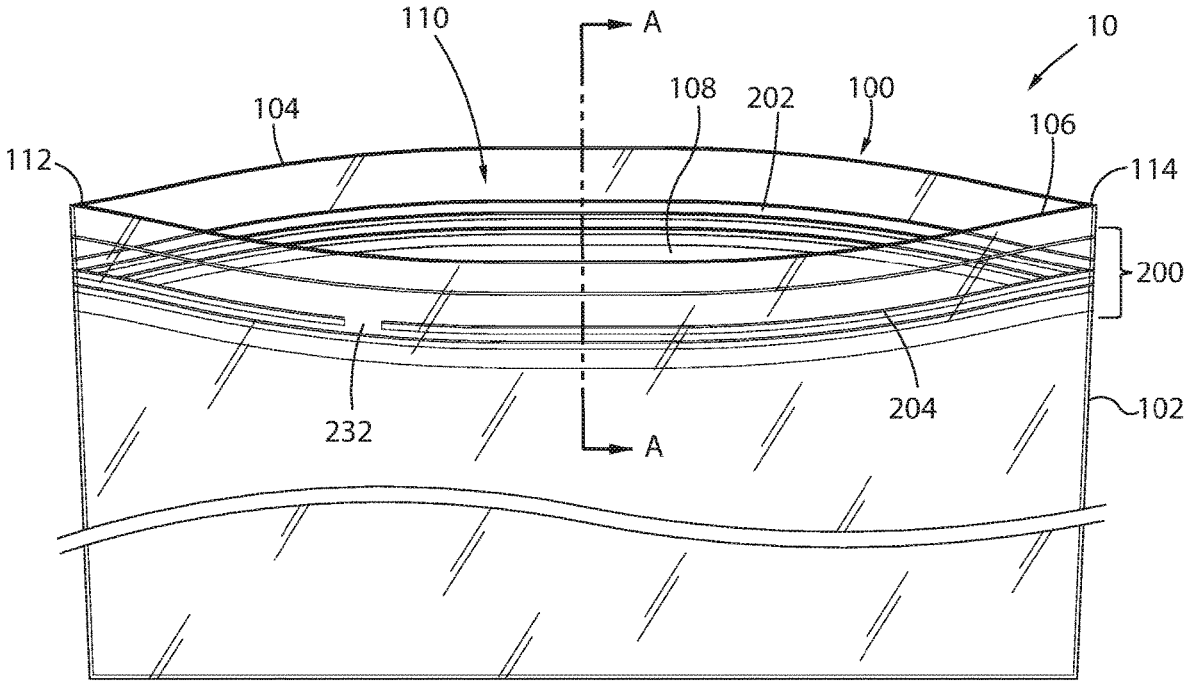
FIG. 1 shows a schematic diagram of a resealable childproof bag system according to exemplary embodiments hereof.

In the following discussion that addresses a number of embodiments and applications of the present invention, reference is made to the accompanying drawings that form a part thereof, where depictions are made, by way of illustration, of specific embodiments in which the invention may be practiced. It is to be understood that other embodiments may be utilized, and changes may be made without departing from the scope of the invention. Wherever possible, the same reference numbers are used in the drawings and the following description to refer to the same or similar elements.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and or steps. Thus, such conditional language is not generally intended to imply that features, elements and or steps are in any way required for one or more embodiments, whether these features, elements and or steps are included or are to be performed in any particular embodiment.

The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present. The term "and or" means that "and" applies to some embodiments and "or" applies to some embodiments. Thus, A, B, and or C can be replaced with A, B, and C written in one sentence and A, B, or C written in another sentence. A, B, and or C means that some embodiments can include A and B, some embodiments can include A and C, some embodiments can include B and C, some embodiments can only include A, some embodiments can include only B, some embodiments can include only C, and some embodiments include A, B, and C. The term "and or" is used to avoid unnecessary redundancy.

While exemplary embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions, and changes in the form of the methods and systems described herein may be made without departing from the spirit of the invention or inventions disclosed herein. Accordingly, the following detailed description does not limit the disclosure. Instead, the proper scope of the disclosure is defined by the appended claims.

Figure 2:
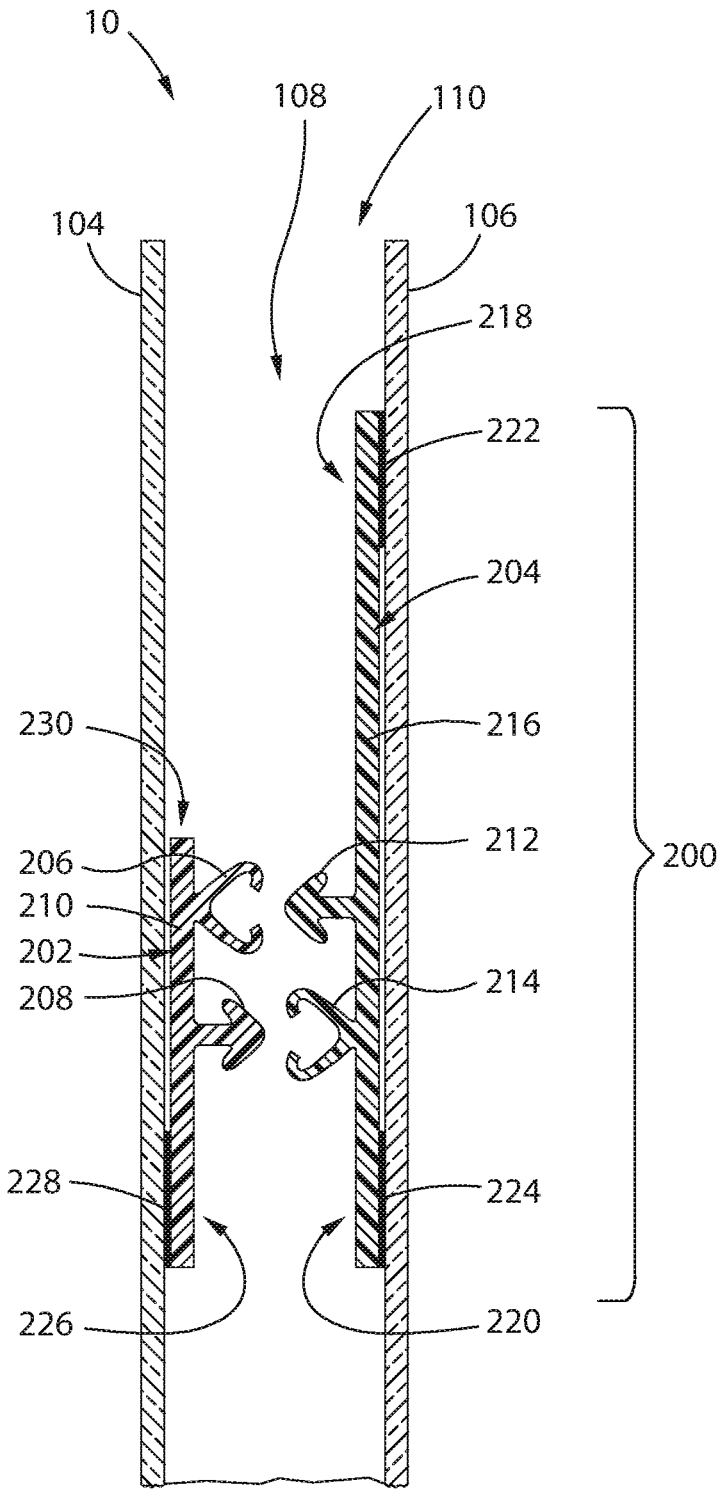
FIG. 2 shows a side view schematic of a resealable childproof bag system according to exemplary embodiments hereof.

In one exemplary embodiment hereof, as shown in FIGS. 1-2, the resealable childproof bag system 10 includes a bag assembly 100 configured with a closure system 200. FIG. 1 shows a schematic diagram of the childproof bag system 10, and FIG. 2 shows a side view of the childproof bag system 10, and more specifically a cross-sectional view of closure system 200, taken from the perspective of cut-lines A-A of FIG. 1. In general, the closure system 200 provides a mechanism to releasably seal the bag assembly 100 in an airtight and childproof fashion.

Note that the elements 100, 200 are depicted as basic shapes to represent the general configuration of the elements 100, 200 with respect to one another. However, it is understood that the representations do not necessarily represent the size, shape or form of the elements 100, 200, nor the proportional sizes of the elements 100, 200 with respect to one another. These details will be described in other sections. The childproof bag system 10 also may include other components and elements as necessary for the system 10 to perform its functionalities.

Bag Assembly 100

In some embodiments as shown in FIG. 1, the bag assembly 100 includes a body 102 comprising a first bag sidewall 104 and a second bag sidewall 106 defining an inner volume 108 therebetween with a top opening 110. The opening 110 includes a left end 112 and a right end 114 that may generally coincide with the left and right edges of the bag's body 102, however, it is understood that while preferable, it may not be necessary for the ends 112, 114 of the opening 110 and those of the body 102 to coincide.

In some embodiments, the first and second sidewalls 104, 106 are connected, such as by folding, heat seal, and/or adhesive, along three peripheral edges to define the sealable interior volume 108 therebetween. The top opening 110 is defined along a top edge where the first and second sidewalls 104, 106 are not connected so as to allow access to the inner volume 108.

In some embodiments, the first and second sidewalls 104, 106 may be formed by known extrusion methods. For example, the sidewalls 104, 106 may be extruded of thermoplastic material as a single continuous single- or multi-ply web. The sidewalls 104, 106 in one embodiment may be formed of multi-layer air impermeable film, such as an EVOH ply adhesively secured between polypropylene and low-density polyethylene plies. It is understood that these examples are meant for demonstration and that the sidewalls 104, 106 may comprise any suitable materials using any suitable production techniques.

It also is understood that the bag assembly 100 may be formed as a pouch, an envelope, a sleeve, a packet, a pocket, any other form of container and as any combinations thereof.

Closure System 200

In some embodiments as shown in FIG. 2, the closure system 200 includes a first closure element 202 configured with the inner surface of the first sidewall 104 of the bag assembly 100, and an opposing second closure element 204 configured with the inner surface of the bag assembly's second sidewall 106. The first and second closure elements 202, 204 are positioned near the top opening 110 in an opposing configuration and extend longitudinally between the opening's left and right ends 112, 114. The first and second closure elements 202, 204 are configured to releasably interlock with one another to form a continuous seal between sidewalls 104, 106 from end 112 to end 114. The elements 202, 204 may comprise thermoplastic or other suitable materials.

In some embodiments, the first closure element 202 includes two elongate locking members 206, 208, each projecting from a common side of a base member 210. Similarly, the second closure element 204 includes two elongate locking members 212, 214, each projecting from a common side of a base member 216. In this opposing configuration, the locking member 206 is configured to releasably interlock with the locking member 212, and the locking member 208 is configured to releasably interlock with locking member 214 to form the seal. The two elongate locking members 206, 208 may be parallel to one another, and the two elongate locking members 212, 214 also may be parallel to one another, but this may not be required.

In some embodiments, the locking members 206 and 214 each include an elongate channel-shaped female interlocking profile, and the locking members 208 and 214 each include an elongate arrow-shaped male interlocking profile. The channel-shaped female interlocking profile of members 206, 214 includes two spaced arms extending from the base members 210, 216, respectively, each arm having an inturned hook at a distal end thereof, to form a channel therebetween. The arrow-shaped male interlocking profile of members 208 and 214 each includes a shaft extending outwardly from the base members 210, 216, respectively, and a symmetrical head with barbs extending from opposite sides of a distal end of the shaft spaced from the base members 210, 216. It is understood that the locking members may be reversed and that the locking members 206 and 214 may include arrow-shaped male interlocking profiles and the locking members 208, 212 may include channel-shaped female interlocking profiles. It also is understood that the above descriptions of the locking member profiles are meant for demonstration and that the locking members 206, 212, and 208, 214 may include any form of interlocking profiles that may provide for the interlocking of the opposing members 206, 212, and 208, 214.

To seal the closure system 200, and thereby seal closed the opening 110, the female interlocking profile of member 206 is interlocked with the male interlocking profile of member 212, and the male interlocking profile of member 208 is interlocked with the female interlocking profile of member 214. This may form two airtight seals (one seal between locking members 206 and 212, and one seal between members 208 and 214) extending from the opening's left end 112 to its right end 114. This in effect may seal the body 102 of the bag assembly 100.

As will be described in other sections, the locking member 212 may include an interruption 232 (e.g., a gap) at a location along its longitudinal length between the ends 112, 114 to facilitate the opening of the closure system 200. In some exemplary embodiments, the interruption 232 may be situated closer to one terminal end of the locking member than the opposite terminal end. In some exemplary embodiments, the interruption 232 may be situated equidistant to each of the two opposing terminal ends of the locking member. In some exemplary embodiments, the interruption 232 may be situated along a portion of the locking member 212 as shown, however, in some exemplary embodiments, the interruption 232 may be situated along a portion of the locking member 206 without deviating from the scope of the present invention.

In some embodiments, the base member 216 includes an upper portion 218 and a lower portion 220. The upper portion 218 may include the area from which the locking members 212, 214 may project. The lower portion 220 may include the area of the base member 216 below the locking members 212, 214.

In some embodiments, the upper portion 218 and the lower portion 220 of the base member 216 are coupled to the inner surface of the sidewall 106 longitudinally from the left end 112 to the right end 114. In some embodiments, the left and right end portions of the base member 216 (that may generally coincide with the first and second ends 112, 114, respectively, of the opening 110) also may be coupled to the sidewall 106. In some embodiments, the coupling in these areas is provided by thermal welding, ultrasonic welding, adhesives, and/or by using other attachment techniques. In some embodiments, an intermediate layer (e.g., a hot layer of thermoplastic weld material) may be disposed between the upper and lower portions 218, 220 of the base member 216 and the sidewall 106 to form a thermoplastic weld therebetween. It is understood that other attachment methods also may be used. In any event, a continuous airtight seal is provided between the portions 218, 220 and the inner surface of the sidewall 106 from end 112 to end 114 as represented by blocks 222, 224 in FIG. 2.

In some embodiments, the base member 210 includes an upper portion 230 and a lower portion 226. The upper portion 230 may include the area from which the locking members 206, 208 may project. The lower portion 220 may include the area of the base member 210 below the locking members 206, 208.

In some embodiments, the lower portion 226 of the base member 210 is coupled to the inner surface of the sidewall 104 longitudinally from the left end 112 to the right end 114. In some embodiments, the left and right end portions of the base member 210 (that may generally coincide with the first and second ends 112, 114, respectively, of the opening 110) also may be coupled to the sidewall 104. Similar bonding techniques as described above may be employed, and a continuous airtight seal between the portion 226 and the inner surface of the sidewall 104 from end 112 to end 114 as represented by block 228 in FIG. 2 is provided.

In some embodiments, the upper portion 230 of the base member 210 is not coupled to the inner surface of the sidewall 104 and remains disconnected therefrom from end 112 to end 114. In this embodiment, only the lower portion 226 of the base member 210 is coupled to the inner surface of the sidewall 104.

In some embodiments, the upper portion 230 of the base member 210 is substantially not coupled to the inner surface of the sidewall 104. For the purposes of this specification, the term "substantially not coupled" means that no more than 0%-20% of the length of the upper portion 230 of the base member 210 is coupled to the sidewall 104, or preferably, no more than 0%-15%, or preferably, no more than 0%-10%, or preferably, no more than 0%-5% of the length of the upper portion 230 of the base member 120 is coupled to the sidewall 104.

Figure 3:
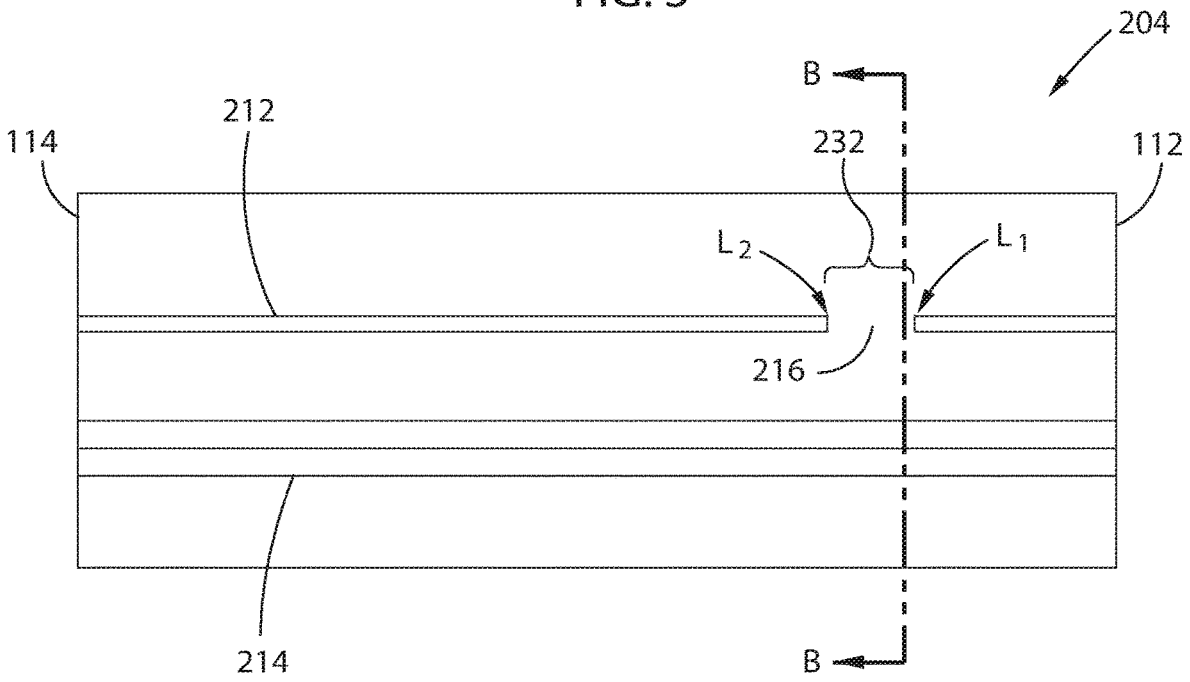
FIG. 3 shows aspects of a resealable childproof bag system according to exemplary embodiments hereof.

In some embodiments as shown in FIG. 3, the locking member 212 on the second closure element 204 includes an interruption 232 (e.g., a gap) at a location along its longitudinal length between the ends 112, 114 such that the male interlocking profile of the member 212 does not exist in this area. The base member 216 may instead be exposed in this area with no male interlocking profile. Accordingly, the locking member 212 may extend from the left end 112 to a first intermediate location $L_1$ between the left end 112 and the right end 114 at which point it may terminate. The locking member 212 also may extend from the right end 114 to a second intermediate location $L_2$ between the right end 114 and the left end 112 at which point it may terminate. In this scenario, the location $L_2$ is closer to the right end 114 than the location $L_1$ is to the right end 114, and the location $L_1$ is closer to the left end 112 than the location $L_2$ is to the left end 112. The interruption 232 thereby extends between locations $L_1$ and $L_2$.

Figure 3A:
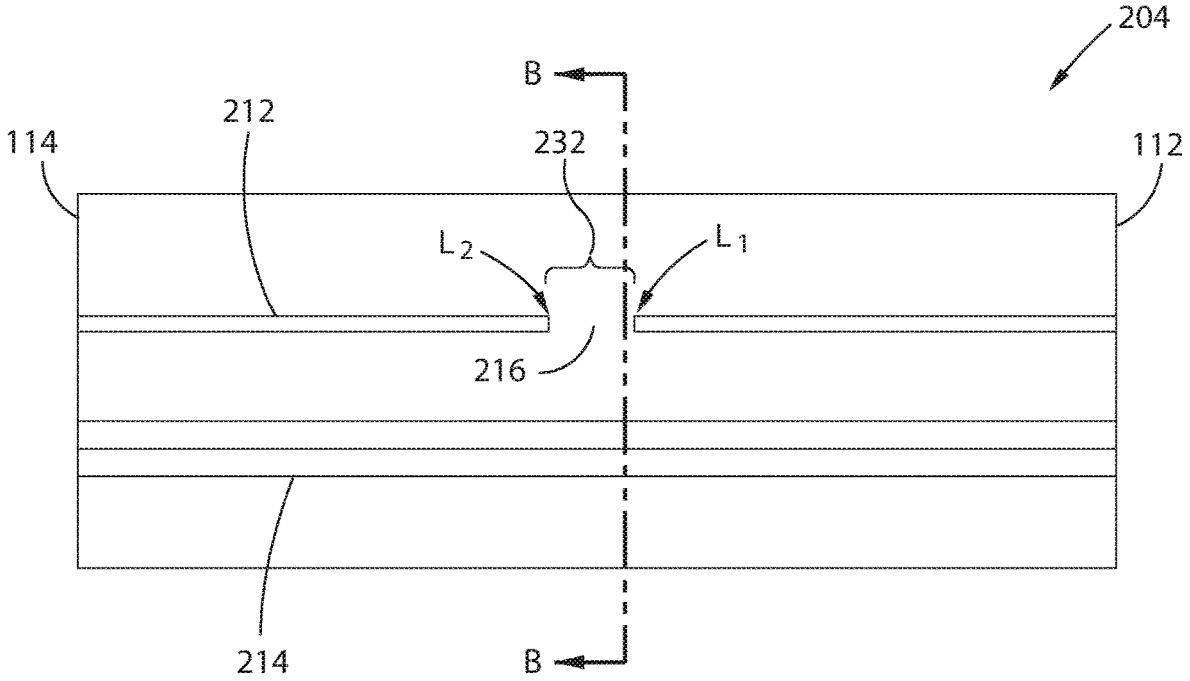
FIG. 3A shows aspects of a resealable childproof bag system according to exemplary embodiments hereof.

In some embodiments, the interruption 232 is situated closer to one end of the bag assembly 100 such as the embodiment illustrated in FIG. 3. However, in some embodiments, the interruption 232 may be situated closer to or at a center region along a length of the bag assembly 100. For example, and without limiting the scope of the present invention, in some embodiments as shown in FIG. 3A, the locking member 212 on the second closure element 204 includes an interruption 232 (e.g., a gap) at a center location along its longitudinal length between the ends 112, 114 such that the male interlocking profile of the member 212 does not exist in this area. The base member 216 may instead be exposed in this area with no male interlocking profile. Accordingly, the locking member 212 may extend from the left end 112 to a first intermediate location $L_1$ between the left end 112 and the right end 114 at which point it may terminate. The locking member 212 also may extend from the right end 114 to a second intermediate location $L_2$ between the right end 114 and the left end 112 at which point it may terminate. In this embodiment, the interruption 232 is approximately centered, such that a length between location $L_2$ and terminal end 114 is substantially similar to or approximately the same as a length between location $L_1$ and terminal end 112. The interruption 232 similarly extends between locations $L_1$ and $L_2$.

Note that it is preferable that the lower locking member 214 extend continually from end 114 to end 112 uninterrupted, and that only the upper locking member 212 is interrupted at the interruption 232. In this way, the closure system 200 may still provide an airtight seal to the bag opening 110 when desired via the lower locking member 214 (when interlocked with locking member 208 of the first locking element 202 to seal the opening 110).

It is further noted that changes to some of the configurations in the exemplary embodiments described with reference to FIG. 3 and FIG. 3A may be achieved within the scope of the present invention. For example, and without limiting the scope of the present invention, the locking members may be reversed and the locking members 206 and 212 may include arrow-shaped male interlocking profiles and the locking members 208, 214 may include channel-shaped female interlocking profiles; in this configuration, the interruption may still be along locking member 212. Notably, in either configuration as mentioned above, the interruption 232 is on a top region or along the upper locking member such that the closure system 200 may still provide an airtight seal to the bag opening 110 when desired via the lower locking member.

Figure 4:
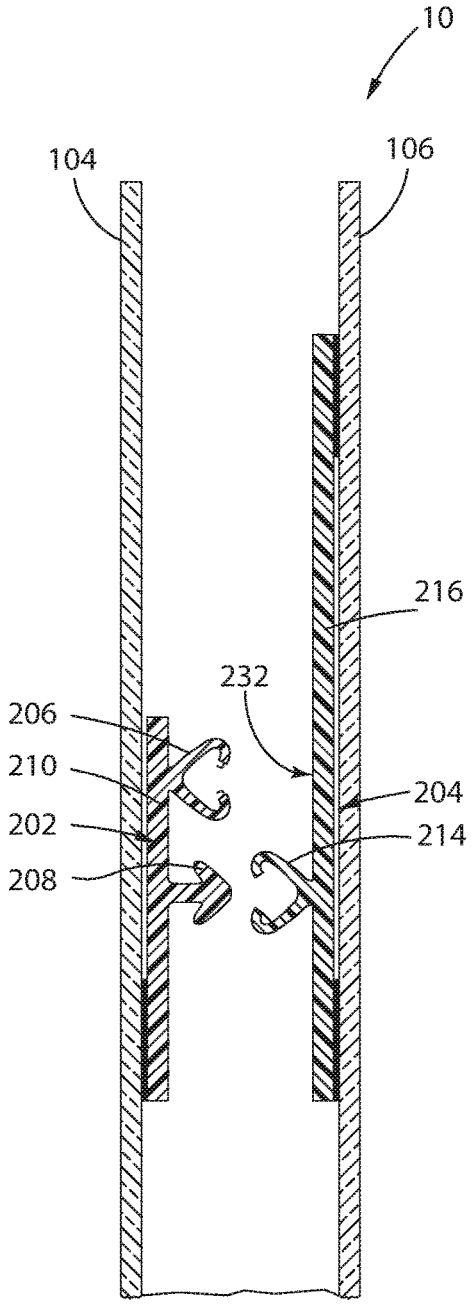
FIG. 4 shows a side view schematic of a resealable childproof bag system according to exemplary embodiments hereof.

FIG. 4 shows the resulting side view of the childproof bag system 10 with the second closure element 204 viewed from the perspective of cut-lines B-B of FIG. 3 (or FIG. 3A). As seen, locking members 208 and 214 are opposing and may be interlocked to form a seal of the bag opening 110. It also is seen that the male interlocking profile of locking member 212 (i.e. a corresponding portion of locking member 212) is nonexistent within the gap or interruption 232, and that consequently, a portion of the locking member 206 is free and unassociated with a corresponding portion of locking member 212 in this area (i.e. the length of interruption 232). As will be described in other sections, this may allow a user to grasp the closure system 200 in this area (i.e. along the gap created by the length of interruption 232) to open the sealed bag assembly 100.

As will be discussed further below, a critical benefit of interruption 232 is its discreet nature. Interruption 232 provides a location for a user to place their finger and support an opening motion that facilitates an otherwise difficult opening procedure. Because children are not generally aware of this feature, the bag system is effectively childproof.

In Use

Figure 5:
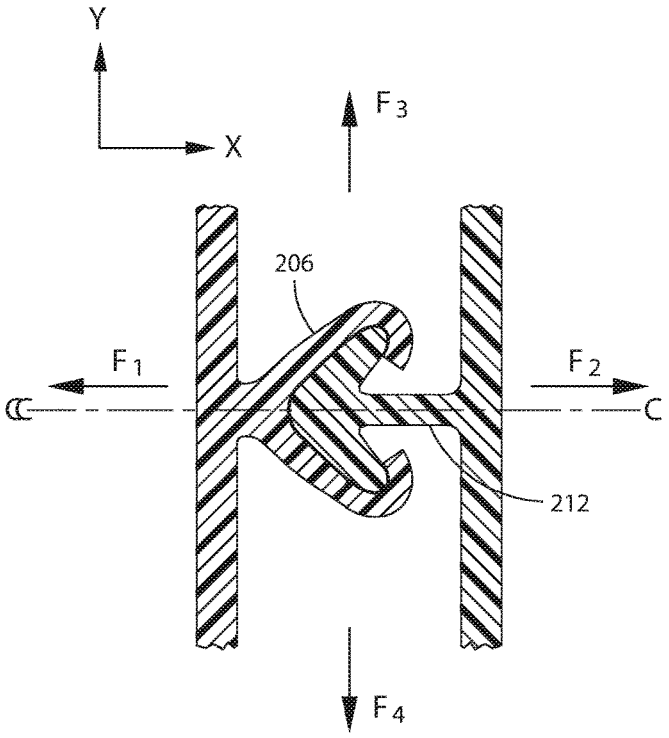
FIG. 5 shows a side view schematic of two interlocked locking members according to exemplary embodiments hereof.
Figure 7:
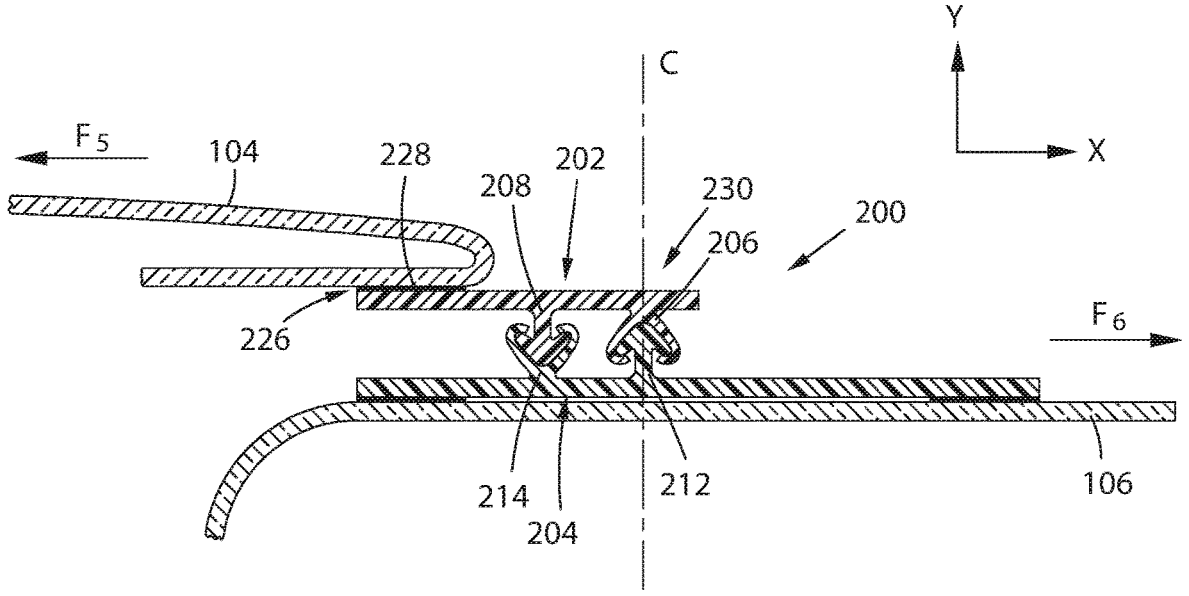
FIG. 7 shows aspects of a resealable childproof bag system according to exemplary embodiments hereof.

FIG. 5 shows a side view of a first locking member 206 interlocked with a second locking member 212 along the axis C (see also FIG. 7). As is known in the art, a pair of interlocked locking members 206, 212 may be separated by applying outward forces $F_1$, $F_2$ generally aligned with the axis C to each respective member 206, 212 as shown.

In addition, it is preferable that the architecture of the interlocked locking members 206, 212 prevents the members 206, 212 from disengaging from one another when forces $F_3$, $F_4$ may be applied in upward and downward directions, respectively, that are generally perpendicular to the axis C.

Figure 6:
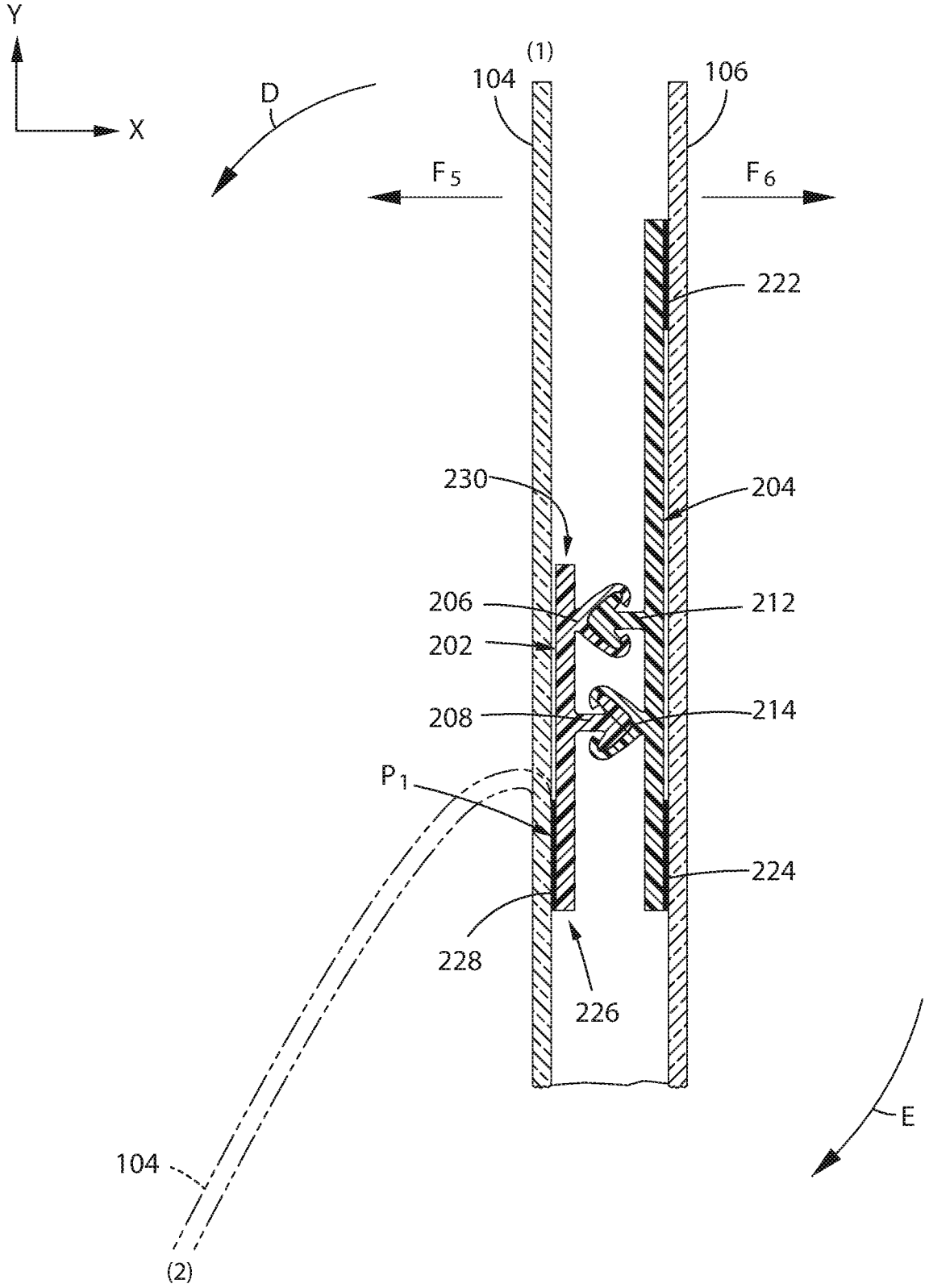
FIG. 6 shows aspects of a resealable childproof bag system according to exemplary embodiments hereof.

FIG. 6 shows a side view of the bag body 102 and closure system 200 sealed. As seen, opposing locking members 206 and 212 are interlocked, and opposing locking members 208 and 214 also are interlocked. Note that the upper portion 230 of the first closure element 202 is not bonded to the sidewall 104, and that only the lower portion 226 of the element 202 is bonded to the sidewall 104 as represented by block 228.

In an attempt to open the childproof bag assembly 10, a user without specific knowledge of the childproof bag system 10 may simply grasp the upper ends of the sidewalls 104, 106 and pull them apart by providing outward forces $F_5$ and $F_6$ as shown. However, in this configuration, when outward forces $F_5$, $F_6$ are applied, the upper portion of the sidewall 104, being unattached from the upper portion 230 of the first closure element 202, may rotate counterclockwise in the direction of arrow D about the pivot point $P_1$ formed by the bond 228 between the first closure element's lower portion 226 and the sidewall 104. Accordingly, the upper portion of the sidewall 104 may generally transition from an upright position at (1) to a downward position at (2). Simultaneously, the upper portion of the sidewall 106 and the second closure element 204 may rotate clockwise in the direction of arrow E.

FIG. 7 shows the arrangement when further forces $F_5$, $F_6$ are applied. As shown, the upper portion of the sidewall 106 and the closure system 200 may generally transition from the vertical orientation of FIG. 6 to a generally horizontal orientation, and the upper portion of the sidewall 104 may fold over and extend horizontally away from the closure system 200 (to the left in FIG. 7).

In this new orientation, it can be seen that the forces $F_5$ and $F_6$ are now generally perpendicular to the axis C passing through the interlocked locking member pairs 206, 212 (similar to forces $F_3$ and $F_4$ in FIG. 5). Given this, and the fact that the architecture of the interlocked locking members 206, 212 and 208, 214 prevents the members 206, 212 and 208, 214 from disengaging from one another when perpendicular forces $F_5$, $F_6$ may be applied, this motion of pulling the upper portions of the sidewalls 104, 106 apart will not cause the closure system 200 to open. Thus, without specific knowledge of the bag system 10, attempting to open the bag system 10 using well-known techniques will preferably fail.

Figure 8:
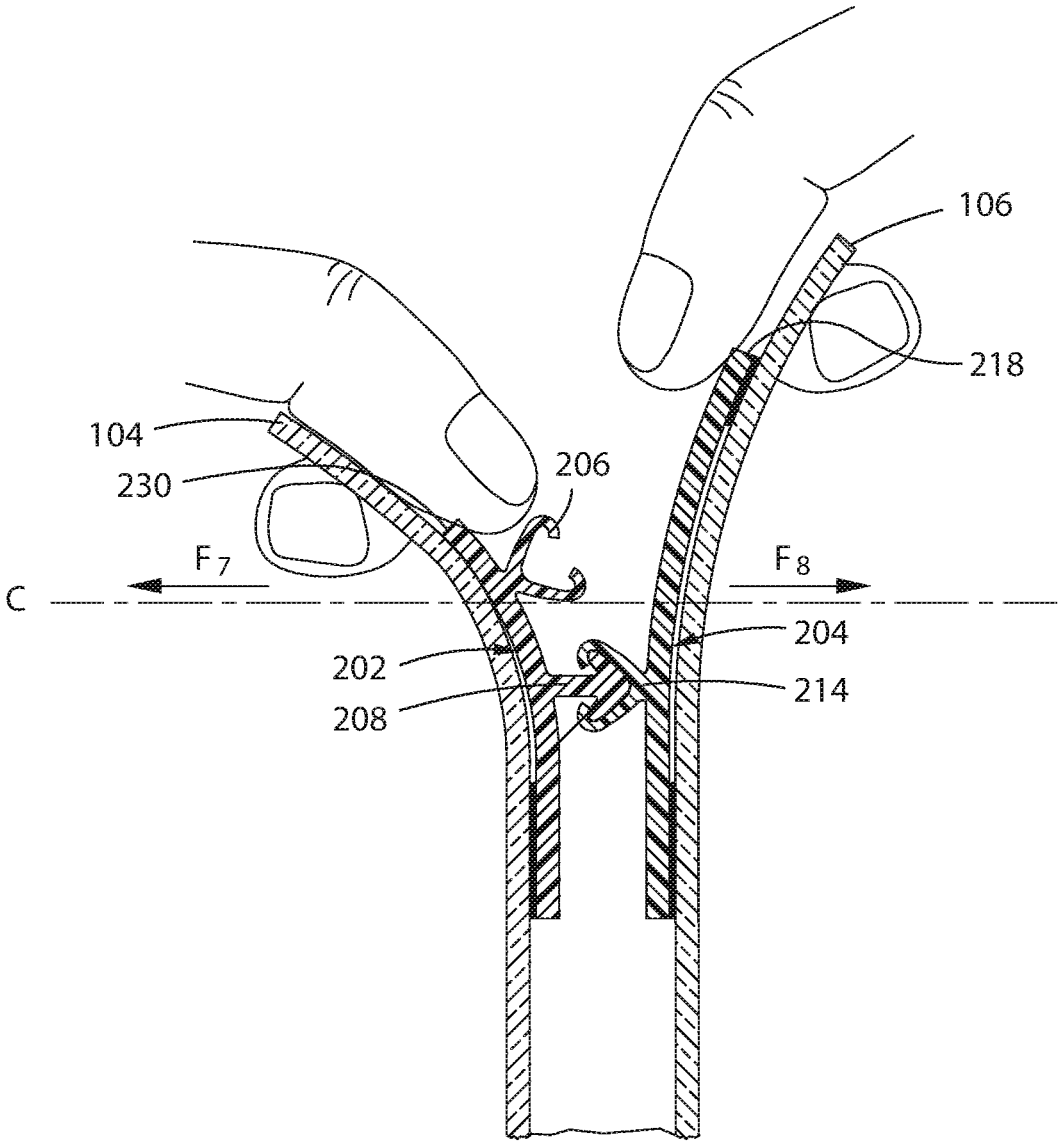
FIG. 8 shows aspects of a resealable childproof bag system according to exemplary embodiments hereof.

In some embodiments as shown in FIG. 8, a user familiar with the childproof bag system 10 may open the bag's closure system 200 by utilizing the functionalities provided by the gap or interruption 232. Because the locking member 206 may be free in the area of the interruption 232, a user may first separate the upper portion 230 of the first closure element 202 from the upper portion 218 of the second closure element 204 by grasping the upper portion 230 of the first closure element 202 in the area of the interruption 232 with the thumb and/or fingers of one hand. Simultaneously, the user also may grasp the upper portion 218 of the second closure element 204 in the area of the interruption 232 with the thumb and/or fingers of the other hand. In this configuration, the user may then apply outward forces $F_7$ and $F_8$ that may cause the locking members 206 and 212 on either side of the interruption 232 (e.g., at the gap expanding between locations $L_1$ and $L_2$) to disengage. The forces $F_7$ and $F_8$ also may cause the locking members 208 and 214 to disengage. In this way, the closure system 200 may be unsealed and the bag 10 may be opened. Given the above procedure, it may be preferable that the length of the interruption 232 be about 0.1"-2.0" and preferably 0.25"-1.0" or about 0.75". However, it is understood that the length of the interruption 232 may be any length as necessary for the bag system 10 to provide its functionalities.

Accordingly, it may be desirable to provide written and/or graphical instructions regarding the above described bag opening procedure on an outside surface of the bag system 10 so that an adult may read and understand the instructions to open the bag system 10. It also may be desirable that a minor may not read and/or understand the instructions so as to prevent the minor from opening the bag system 10.

It is understood that any aspect and/or element of any embodiment of the bag system 10 described herein or otherwise may be combined in any way to form additional embodiments of the bag system 10 all of which are within the scope of the bag system 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs" and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

A bag including a childproof resealable closure system has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching without departing from the spirit of the invention.

What is claimed is:

1. A resealable bag system comprising:

a bag body including a first sidewall and an opposing second sidewall defining an inner volume therebetween with an upper opening defining a top of the resealable bag system and extending from a first end to a second end;

a first closure element comprising:

a first locking member and a second locking member below the first locking member, each protruding from a first base member, the first locking member, the second locking member and the first base member extending from the first end to the second end, the first end and the second end defining a first locking member longitudinal axis; and a second closure element comprising:

a third locking member and a fourth locking member below the third locking member, each protruding from a second base member, the fourth locking member and the first base member extending from the first end to the second end, the third locking member extending from the first end and terminating at a first intermediate location between the first end and the second end, and extending from the second end and terminating at a second intermediate location between the first end and the second end, the first intermediate location and the second intermediate location separated by a single gap that facilitates opening the first and second closure elements;

wherein the first and second locking members are adapted to be releasably interlocked with the third and fourth locking members, respectively; and wherein the first and second locking members when interlocked form a separation location with the single gap located opposite to the first locking member from a perspective orthogonal to the first locking member longitudinal axis.

2. The resealable bag system of claim 1, wherein a lower portion of the first base member is coupled to the first side wall.

3. The resealable bag system of claim 1, wherein the second base member includes an upper portion and a lower portion each coupled to the opposing second sidewall.

4. The resealable bag system of claim 1, wherein a shortest distance between the first intermediate location and the second intermediate location is at least one of: 0.1" to 2.0", 0.25" to 1.0", and 0.75".

5. The resealable bag system of claim 1, wherein the first intermediate location is closer to the first end than the second intermediate location is from the first end.

6. The resealable bag system of claim 2, wherein 0%-20% of a total length of an upper portion of the first base member is coupled to the first side wall.

7. A resealable bag system comprising:

a bag body including a first sidewall and an opposing second sidewall defining an inner volume therebetween with an upper opening defining a top of the resealable bag system and extending from a first end to a second end;

a first closure element comprising:

a first locking member and a second locking member below the first locking member, each protruding from a first base member, the first locking member, the second locking member and the first base member extending from the first end to the second end; and a second closure element comprising:

a third locking member and a fourth locking member below the third locking member, each protruding from a second base member, the fourth locking member and the first base member extending from the first end to the second end, the third locking member extending from the first end and terminating at a first intermediate location between the first end and the second end, and extending from the second end and terminating at a second intermediate location between the first end and the second end, the first intermediate location and the second intermediate location separated by a single gap that facilitates opening the first and second closure elements;

wherein the second base member includes an upper portion and a lower portion, the upper portion and the lower portion coupled to the second sidewall;

wherein the first and second locking members are adapted to be releasably interlocked with the third and fourth interlocking members, respectively; and wherein the first and second locking members when interlocked form a separation location with the first locking member extending across the single gap from the first intermediate location to the second intermediate location.

8. The resealable bag system of claim 7, wherein a shortest distance between the first intermediate location and the second intermediate location is at least one of: 0.1" to 2.0", 0.25" to 1.0", and 0.75".

9. The resealable bag system of claim 7, wherein no more than 20% of a total length the upper portion of the first base member is coupled to the first side wall.

10. The resealable bag system of claim 7, wherein no more than 10% of a total length of an upper portion of the first base member is coupled to the first side wall.

11. The resealable bag system of claim 1 wherein the first base member includes an upper portion and a lower portion, the lower portion coupled to the first sidewall and the upper portion substantially not coupled to the first sidewall.

12. The resealable bag system of claim 1 wherein the separation location includes the first locking member extending across the single gap from the first intermediate location to the second intermediate location.

13. The resealable bag system of claim 7 wherein the first base member includes an upper portion and a lower portion, the lower portion coupled to the first sidewall and the upper portion substantially not coupled to the first sidewall.

14. The resealable bag system of claim 7 wherein the first end and the second end define a first locking member longitudinal axis, and the single gap is located opposite to the first locking member from a perspective orthogonal to the first locking member longitudinal axis.

15. The resealable bag system of claim 7 wherein the seal separation mechanism includes the first locking member extending across the entirety of the single gap.

* * * * *